US005918484A

United States Patent [19]

Exner

[11] Patent Number: 5,918,484

[45] Date of Patent: Jul. 6, 1999

[54] WARP KNITTING MACHINE WITH FALL PLATE BAR

[75] Inventor: Franz Exner, Muhlheim, Germany

[73] Assignee: Karl Mayer Textilmaschinenfabrik, Obertshausen, Germany

[21] Appl. No.: 09/123,239

[22] Filed: Jul. 28, 1998

[30] Foreign Application Priority Data

Aug. 20, 1997 [DE] Germany ..... 197 36 123

[51] Int. Cl.[6] ..... D04B 27/24

[52] U.S. Cl. ..... 66/204

[58] Field of Search ..... 66/82 R, 203, 66/204, 207, 208, 206

[56] References Cited

U.S. PATENT DOCUMENTS 3,403,536 10/1968 Inabi ..... 66/207
3,469,419 9/1969 Kohl ..... 66/207
5,520,023 5/1996 Kemper .

FOREIGN PATENT DOCUMENTS 1585511 3/1970 Germany ..... 66/207
6606595 10/1970 Germany .
1585440 12/1970 Germany .

*Primary Examiner*—John J. Calvert
*Assistant Examiner*—Larry D. Worrell, Jr.
*Attorney, Agent, or Firm*—Omri M. Behr, Esq.

[57] ABSTRACT

There is provided a warp knitting machine with a fall plate bar having a guide bar assembly carrying guide bars 2 and 3, a supplemental shaft 8 which rotates in dependence upon the main shaft 9 and carries steering device 11. These are part of a fall plate drive which moves the fall plate bar 25 to and fro via a lever arrangement 27. This construction has a comparatively low mass and permits higher drive speeds.

10 Claims, 1 Drawing Sheet

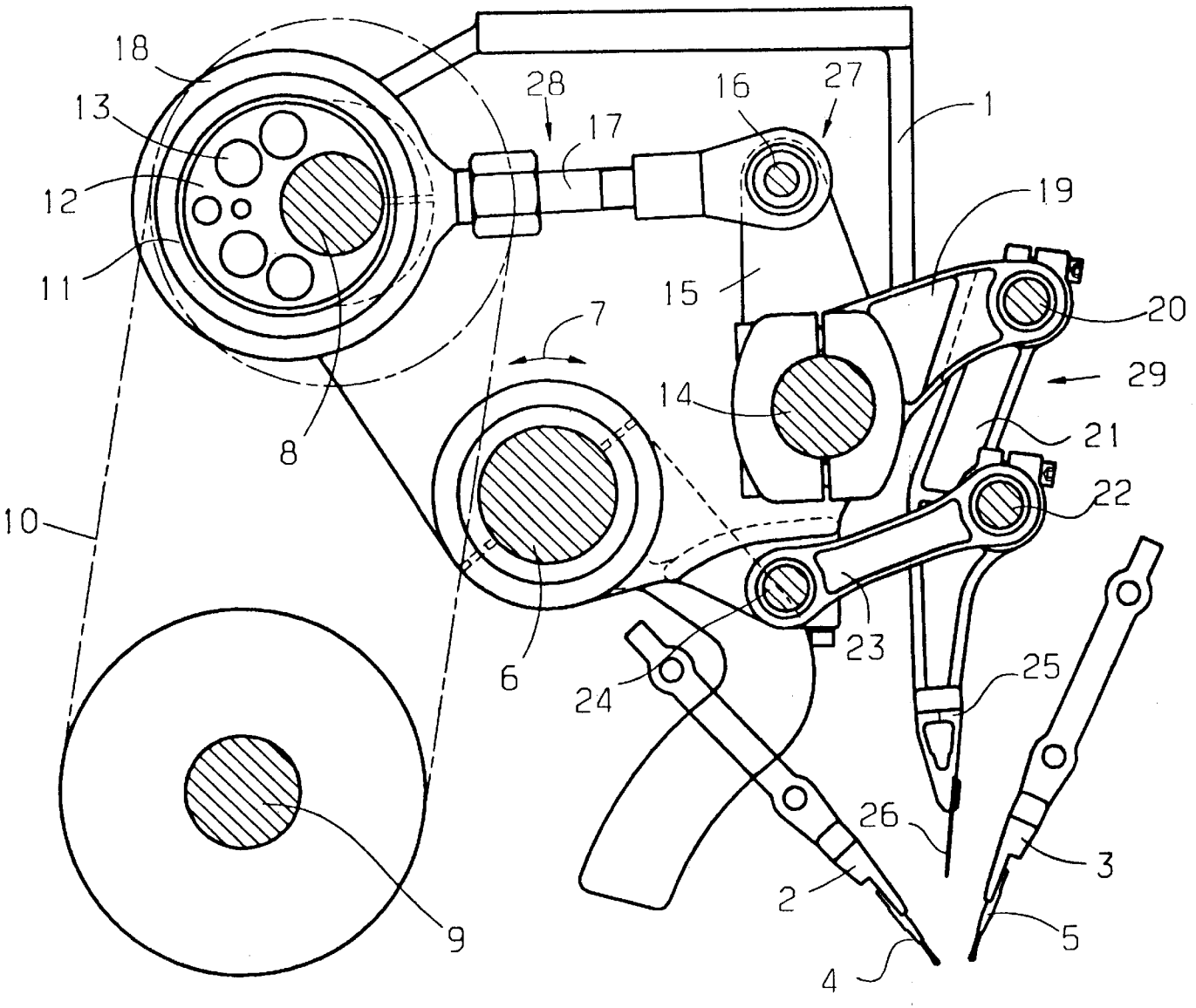
1
2
3
4
5
6
7
8
9
10
11
12
13
14
15
16
17
18
19
20
21
22
23
24
25
26
27
28
29

WARP KNITTING MACHINE WITH FALL PLATE BAR

BACKGROUND OF THE INVENTION

1. Field of the Invention

The present invention relates to a warp knitting machine with a fall plate bar, which is attached to a guide bar assembly carrying a guide bar and having a fall plate drive, which is movable to and fro by cam plates rotating with the main shaft and a lever arrangement activated thereby.

2. Description of Related Art

In the known warp knitting machines of this type (DE 15 854 40), the fall plate bar is held by rods which are led into a guide means of a guide bar assembly carrying the guide bar and are moved to and fro by eccentric cams attached to the main shaft via a multi-membered lever arrangement.

The lever arrangement is laid out so that the steering of the fall plate bar is maintained during the swing movement of the carrier. Such a sinker plate drive can only be utilized for machine speeds of up to approximately 500 rpm of the main shaft.

From U.S. Pat. No. 5,520,023, it is known to arrange tool bars which carry needles, sliders, or sinkers on a carrier arm which is part of a joint-quadrilateral and is displaceable back and forth by a shaft swinging to and fro.

A fall plate control is also known (DE-SM 66 06 595) in which the fall plate movement varies and in particular can be shut off in dependence on the pattern. This is achieved thereby that the joint bushings of a push rod driven by the eccentric shaft of the machine grips onto a toggle lever, combined with the fall plate and furthermore the toggle lever is displaceable by a further push rod controlled by a pattern chain.

The purpose of the present invention is to provide a warp knitting machine of the heretofore described art which can operate at higher speeds.

SUMMARY OF THE INVENTION

In accordance with the illustrative embodiments demonstrating features and advantages of the present invention, there is provided a warp knitting machine having a main shaft and a guide bar assembly. The guide bar assembly has a guide bar supported thereon and is rotated in dependence upon the main shaft. The machine also has a supplemental shaft (a) mounted in the guide bar assembly, and (b) rotatably driven in dependence upon the main shaft. Also included is a steering means carried by the supplemental shaft and arranged to be driven in dependence upon the main shaft. The machine also has a fall plate bar attached to the guide bar assembly, and a fall plate drive coupled to the fall plate bar. The fall plate drive has a lever arrangement reciprocatably driven by the steering means.

By employing apparatus of the foregoing type, advantages are achieved wherein a supplemental shaft is borne by the guide bar assembly, which rotates in dependence upon the main shaft and preferably carries cam plates for driving the fall plate bar.

By means of the preferred construction, the mass of the rapidly reciprocating portions of the fall plate drive, which are substantially located in the lever arrangement between the supplemental shaft and the fall plate bar in the area of the guide bar assembly, is substantially reduced. The supplemental shaft plays only a subordinate role with respect to the mass damping, since it is continually, and apart from certain exceptions, rotated uniformly. Thus, the accelerative and decelerative forces which must be overcome in the operation, are substantially smaller than before, and therefore enable higher machine speeds, for example 600 to 700 rpm.

Preferably, the supplemental shaft is connected to the main shaft by a drive means. No additional drive unit is required and there is no synchronization load.

In particular, the drive can be a chain or belt drive. This type of drive raises no problems with respect to the to and fro swinging of the assembly together with the supplemental shaft borne thereby, between an underlap and an overlap position.

In a preferred embodiment, cam plates are formed by eccentrics attached to the supplemental shaft. These circular formed control cams which are coupled to the main shaft can also be utilized with the supplemental shaft.

In particular, the eccentrics may be formed by circular disks which, for weight-saving, may have holes therein.

In one preferred embodiment, it is provided that a fall plate shaft is borne in a guide bar assembly which is swung to and fro by the eccentric via a first half of a lever arrangement and thus moves the fall plate bar via a second part of the lever arrangement. Such a lever arrangement, divided in two by the fall plate shaft allows the achievement of space-savings with smaller mass.

It is furthermore desirable that the fall plate bar is attached to a carrier arm which is connected via a jointed steering lever attached to the fall plate shaft, and via a jointed lever is attached to a bearing in the guide bar assembly. When the carrier arm, the steering lever, and the jointed lever form a parallelogram with the carriage, the fall plate bar performs a linear to and fro movement. Through deviations from the parallelogram form, a different movement path can be achieved.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying single drawing, showing those parts of the warp knitting machine that are necessary for a drive of the fall plate bar.

DETAILED DESCRIPTION OF THE PREFERRED EMBODIMENTS

The guide bar assembly (1) carries guide bars (2) and (3) with the guides (4) and (5) appropriate thereto. Assembly (1) is swingable by means not shown, about a machine fixed axle (6) in the direction of arrow (7) in order to swing the guides from the underlap position to the overlap position and back again.

On this guide bar assembly (1), there is carried a supplemental shaft (8) which can be caused to rotate by a drive means (10). Drive means 10 may be a belt drive or chain drive from main shaft (9) and thus runs with it continually and uniformly. It will be appreciated that drive means 10 is only a schematic representation and that more practical embodiments will employ a number of intervening mechanisms. Supplemental shaft (8) carries steering means, that is, cams (11) in the form of an eccentrics (12), which are formed as circular disks provided with holes (13) serving for weight reduction.

On a fall plate shaft (14) similarly borne in guide bar assembly (1), an outrigger (15) is attached which is connected via joint (16) with the rod (4) of a connecting collar (18) encircling eccentric (12). This fall plate shaft (14) is moved to and fro in its bearing by means of the rotation of shaft (8).

Furthermore, a steering, first lever (19) is attached to the fall plate shaft (14) and with carrier arm (21) by means of joint (20). This carrier arm is further connected via joint (22) with driven, second lever (23), which itself is connected to the guide bar assembly (1) via bearing (24).

The carrier arm (21) carries a fall plate bar (25), whose lower end is provided with a fall plate (26).

Since the steering lever (19), the carrier arm (21), the driven lever (23), and the guide bar assembly (1) form a quadrilateral that is a parallelogram, the fall plate (26) moves straight up and down during the rotation of the supplemental shaft (8). The lever arrangement (27), extending between the supplemental shaft (8) and the fall plate shaft (14), is divided into two parts (28) and (29) and acts as a fall plate drive. A first part (28) extends over the axle (6) attached to the housing. The second part (29) is next to this axle (6). A space saving lever arrangement thus arises with few and small parts which, because of their small mass, permit high operative speeds.

In deviations from the presented embodiments are possible in several ways without departing from the basic concept of the invention. For example, the drive for the supplemental shaft (8) can occur through its own motor synchronized with the main shaft. Other drives (10) may also be utilized such as a cam mechanism in place of the chain or belt drive.

Obviously, many modifications and variations of the present invention are possible in light of the above teachings. It is therefore to be understood that within the scope of the appended claims, the invention may be practiced otherwise than as specifically described.

I claim:

1. Warp knitting machine comprising:

a main shaft;

a guide bar assembly having a guide bar supported thereon and being rotated in dependence upon the main shaft;

a supplemental shaft mounted in the guide bar assembly, and rotatably driven in dependence upon the main shaft;

a steering means carried by said supplemental shaft and arranged to be driven in dependence upon said main shaft;

a fall plate bar attached to said guide bar assembly; and a fall plate drive coupled to said fall plate bar and having a lever arrangement reciprocatably driven by said steering means.

2. Warp knitting machine in accordance with claim 1, comprising:

a drive means mechanically coupled to said supplemental shaft for driving it.

3. Warp knitting machine in accordance with claim 2, wherein the drive means comprises a chain drive.

4. Warp knitting machine in accordance with claim 2, wherein the drive means comprises a belt drive.

5. Warp knitting machine in accordance with claim 1 wherein said steering means comprises:

an eccentric attached to the supplemental shaft.

6. Warp knitting machine in accordance with claim 5, wherein the eccentric comprises:

a circular disk having weight saving holes.

7. Warp knitting machine in accordance with claim 1 comprising:

a fall plate shaft borne in the guide bar assembly, the lever arrangement including:

a first part and a second part, interconnected and driven by the steering means for reciprocating said fall plate bar through said fall plate shaft.

8. Warp knitting machine in accordance with claim 7 wherein said second part of said lever arrangement comprising:

a carrier arm supporting said fall plate bar;

a first lever coupled between said carrier arm and said fall plate shaft; and a second lever coupled between said carrier arm and said guide bar assembly.

9. Warp knitting machine in accordance with claim 5 comprising:

a fall plate shaft borne in the guide bar assembly, the lever arrangement including:

a first part and a second part, interconnected and driven by the steering means for reciprocating said fall plate bar through said fall plate shaft.

10. Warp knitting machine in accordance with claim 9 wherein said second part of said lever arrangement comprising:

a carrier arm supporting said fall plate bar;

a second lever coupled between said carrier arm and said fall plate shaft; and a second lever coupled between said carrier arm and said guide bar assembly.

* * * * *